US010221674B2

(12) United States Patent
Samuel

(10) Patent No.: US 10,221,674 B2
(45) Date of Patent: Mar. 5, 2019

(54) METHOD AND APPARATUS FOR CASING THICKNESS ESTIMATION

(71) Applicant: Landmark Graphics Corporation, Houston, TX (US)

(72) Inventor: Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 122 days.

(21) Appl. No.: 15/037,843

(22) PCT Filed: Jan. 2, 2014

(86) PCT No.: PCT/US2014/010041

§ 371 (c)(1),
(2) Date: May 19, 2016

(87) PCT Pub. No.: WO2015/102633

PCT Pub. Date: Jul. 9, 2015

(65) Prior Publication Data

US 2016/0290123 A1 Oct. 6, 2016

(51) Int. Cl.

| | |
|---|---|
| ***E21B 47/00*** | (2012.01) |
| ***E21B 12/02*** | (2006.01) |
| ***E21B 49/00*** | (2006.01) |
| ***E21B 3/00*** | (2006.01) |
| ***E21B 44/00*** | (2006.01) |
| ***E21B 7/04*** | (2006.01) |

(52) U.S. Cl.

CPC ..... *E21B 47/0006* (2013.01); *E21B 3/00* (2013.01); *E21B 12/02* (2013.01); *E21B 44/00* (2013.01); *E21B 49/006* (2013.01); *E21B 7/04* (2013.01)

(58) Field of Classification Search

None

See application file for complete search history.

(56) References Cited

U.S. PATENT DOCUMENTS

| | | | | |
|---|---|---|---|---|
| 4,103,748 | A * | 8/1978 | Arnold | E21B 7/04 166/242.4 |
| 4,573,540 | A | 3/1986 | Dellinger et al. | |
| 6,316,937 | B1 | 11/2001 | Edens | |
| 7,346,455 | B2 | 3/2008 | Ward et al. | |
| 2004/0256101 | A1 * | 12/2004 | Fox | E21B 47/00 166/252.5 |

(Continued)

FOREIGN PATENT DOCUMENTS

| | | | |
|---|---|---|---|
| WO | WO 2005/008019 | A1 | 1/2005 |
| WO | WO-2015102633 | A1 | 7/2015 |

OTHER PUBLICATIONS

Kumar, et al., Analytical Model to Estimate the Downhole Casing Wear Using the Total Wellbore Energy, Journal of Energy Resources Technology, Dec. 2013, 135.*

(Continued)

*Primary Examiner* — Alexander Satanovsky
*Assistant Examiner* — Lina M Cordero

(57) ABSTRACT

Various embodiments include apparatus and methods to provide an estimation of casing wear. One method determines values of casing and drill string variables and constants. These constants and variables are used to dynamically generate an estimate of casing wear, based on a stress theory. The drilling operation can be halted when the estimate of casing wear reaches a predetermined value.

19 Claims, 5 Drawing Sheets

(56) References Cited

U.S. PATENT DOCUMENTS

| | | | | |
|---|---|---|---|---|
| 2005/0071120 | A1 | 3/2005 | Hutchinson | |
| 2010/0037675 | A1 | 2/2010 | Hannahs et al. | |
| 2010/0044110 | A1 | 2/2010 | Bangru et al. | |
| 2012/0016589 | A1 | 1/2012 | Li et al. | |
| 2012/0136577 | A1* | 5/2012 | Dria | E21B 41/02 702/11 |

OTHER PUBLICATIONS

"Australian Application Serial No. 2014374464, First Examiner Report dated Aug. 5, 2016", 3 pgs.
"European Patent Application No. 14877094.4, Office Action dated Jun. 14, 2016", 2 pgs.
"European Patent Application No. 14877094.4, Response filed Aug. 4, 2016 to Office Action dated Jun. 14, 2016", 10 pgs.
"International Application Serial No. PCT/US2014/010041, International Preliminary Report on Patentability dated Jul. 14, 2016", 14 pgs.
Grigoras, Stefan, et al., "The Correlation Between Tribological and Functional Aspects on Casing and Tubing Joints", *The Annual of University "Dunarea de Jos" of Galati Fascicle VIII Tribiology*, (2003), 189-192.
Deli et al., "Prediction of Casing Wear in Extended-Reach Drilling," *Petroleum Science, China University of Petroleum* (*Beijing*), Nov. 10, 2010, vol. 7, Issue 4, pp. 494-501.
Extended European Search Report for EP 14877094.4, dated Jun. 2, 2017, 8 pages.
"International Application Serial No. PCT/US2014/010041, International Search Report dated Oct. 20, 2014", 3 pgs.
"International Application Serial No. PCT/US2014/010041, Written Opinion dated Oct. 20, 2014", 12 pgs.

* cited by examiner

METHOD AND APPARATUS FOR CASING THICKNESS ESTIMATION

PRIORITY APPLICATION

This application is a U.S. National Stage Filing under 35 U.S.C. 371 from International Application No. PCT/US2014/010041, filed on 2 Jan. 2014, and published as WO 2015/102633 A1 on 9 Jul. 2015, which applications and publication are incorporated herein by reference in their entirety.

BACKGROUND

Casing wear resulting from borehole drilling and back-reaming can have an impact on the integrity of the borehole casing, liner, and riser. The casing wear can be attributed to large bit footage, high rotating hours, and increased contact force between the drill string and the casing. A crescent-shaped groove, resulting from the casing wear, that exceeds allowable limits in the casing wall can jeopardize the casing integrity and cause the abandonment of a hole before reaching target depth. Tool joint wear can also result from the contact between the drill string and the casing.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

Casing wear, sometimes appearing in the form of a crescent-shaped groove, can result from a large bit footage, high rotating hours, and/or increased contact force between the drill string tool joint and the casing. Hertzian contact mechanics can be used to identify the loading conditions that may cause deformation to begin in the casing.

Figure 1:
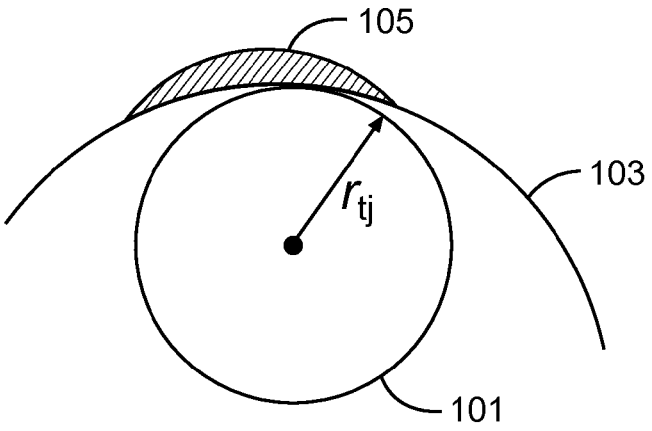
FIG. 1 shows an embodiment of a deformable casing pressed against a tool joint.

FIG. 1 illustrates a rigid drill string tool joint 101 pressed against a deformable casing 103. During a drilling operation, the casing 103 can exhibit wear 105 from the drill string tool joint 101.

The rate of casing volume wear can be represented by:

$$\frac{dV}{dt} = 2\pi r_{tj} L \frac{dr}{dt} \quad \text{(Eq. 1)}$$

where:

$r_{tj}$=radius of the tool joint,

L=drilling distance (ft) of the tool joint, and dr/dt=rate of change in the radius due to wear with respect to time.

If δ represents the thickness of the casing that is worn from wear and differentiating with respect to time, t:

$$\frac{d\delta}{dt} = \frac{dr}{dt} \quad \text{(Eq. 2)}$$

After substituting Eq. 2 into Eq. 1, Eq. 1 becomes:

$$\frac{dV}{dt} = 2\pi r_{tj} L \frac{d\delta}{dt} \quad \text{(Eq. 3)}$$

Eq. 3 can be rearranged as:

$$\frac{dV}{dt} = 2\pi r_{tj} L \frac{d\delta}{d\theta} \frac{d\theta}{dt} \quad \text{(Eq. 4)}$$

Given:

$$\frac{d\theta}{dt} = \varpi = 2\pi N \quad \text{(Eq. 5)}$$

Substituting Eq. 5 into Eq. 4 yields:

$$\frac{dV}{dt} = \pi D_{tj} N L \frac{d\delta}{d\theta} \quad \text{(Eq. 6)}$$

Assuming the rate of wear is uniform throughout the casing at different azimuthal angles, it can be assumed that the rate of wear at different angular positions is directly proportional to the maximum stress at the point of contact between the tool and the casing. So:

$$\frac{d\delta}{d\theta} = k\sigma_{max} \quad \text{(Eq. 7)}$$

where k=a proportionality constant that depends on the casing material and a wear coefficient.

Substituting Eq. 7 into Eq. 6 produces:

$$\frac{dV}{dt} = \pi D_{tj} N L k L \sigma_{max} \quad \text{(Eq. 8)}$$

A tool joint can have a hard coating to prevent the associated drill pipe from touching the wellbore wall and causing excessive wear to the tool joint. However, the hard coating can cause wear in the casing that is typically referred to as "tool joint hard banding". Contact stresses can be functions of tool joint geometry, material properties of tool joint hard banding, and/or the contact forces acting between the tool joint and the casing. A large number of cyclic contact stresses can cause excessive casing wear and tool joint wear. As a result, physical deterioration can occur on both of the engaged surfaces but may be more conspicuous in the weaker material (e.g., casing).

Because of the sliding velocity between the tool and the casing, elastohydrodynamic effects may be present in the casing element that can alter the stress distribution. Dynamic loading is another factor that can alter the stress at contact points between the tool and casing. Such dynamic loading can occur when the drill string vibrates and touches the casing with an impact loading instead of static loading.

Using a classical Hertzian approach, the maximum compressive stress at the point of contact between the casing and the tool joint can be expressed as:

$$\sigma_{max} = 0.564\left[\frac{F_n\frac{(\rho_c-\rho_{tj})}{\rho_c\rho_{tj}}}{\left(\frac{1-v_c^2}{E_c}\right)+\left(\frac{1-v_{tj}^2}{E_{tj}}\right)}\right]^{\frac{1}{2}} \quad \text{(Eq. 9)}$$

where:

$F_n$=normal load per unit width of the contacting element that is calculated based on the position of the drill string (e.g., inclination, azimuth), $\rho_c$, $\rho_{tj}$=radii of curvature of casing and tool joint, respectively, $E_c$, $E_{tj}$=modulii of elasticity of casing and tool joint, respectively, and $v_c$, $v_{tj}$=Poisson's ratio of casing and tool joint, respectively.

Substituting Eq. 9 into Eq. 8 yields:

$$\frac{dV}{dt} = \pi 0.564 D_{tj}NLk\left[\frac{F_n\frac{(\rho_c-\rho_{tj})}{\rho_c\rho_{tj}}}{\left(\frac{1-v_c^2}{E_c}\right)+\left(\frac{1-v_{tj}^2}{E_{tj}}\right)}\right]^{\frac{1}{2}} \quad \text{(Eq. 10)}$$

To evaluate the force, $F_n$, acting on the contact point, Eq. 10 can be integrated and the sliding distance replaced with a rotational speed in revolutions per minute (RPM). This results in the volume, V, that is removed per linear distance from the casing as a result of contact between the rotating drill string and the casing:

$$V = \pi 0.564 F_n D_{tj}NLt\left[\frac{\frac{(\rho_c-\rho_{tj})}{\rho_c\rho_{tj}}}{\left(\frac{1-v_c^2}{E_c}\right)+\left(\frac{1-v_{tj}^2}{E_{tj}}\right)}\right]^{\frac{1}{2}} \text{inches}^3/\text{feet} \quad \text{(Eq. 11)}$$

where:

N=rotary speed (revolutions per minute)

$D_{tj}$=tool joint diameter (inches)

t=contact time (minutes)

The contact time, t, between the rotating drill string and the casing can be expressed by:

$$t = \frac{L\times L_{tj}}{ROP\times L_{dp}}\text{min.} \quad \text{(Eq. 12)}$$

where

L=drilling distance (depth in feet) so that:

$L_{tj}$=drilling distance (depth in feet) of the tool joint, $L_{dp}$=drilling distance (depth in feet) of the drill string; and ROP=rate of penetration into a geological formation in feet/minute The volume removed per linear distance, as expressed by the model of Eq. 11, can be used in multiple modes of a drilling operation. These modes can include pre-planning for the drilling operation, real-time analysis of the drilling operation, and post-planning of the drilling operation.

Figure 2:
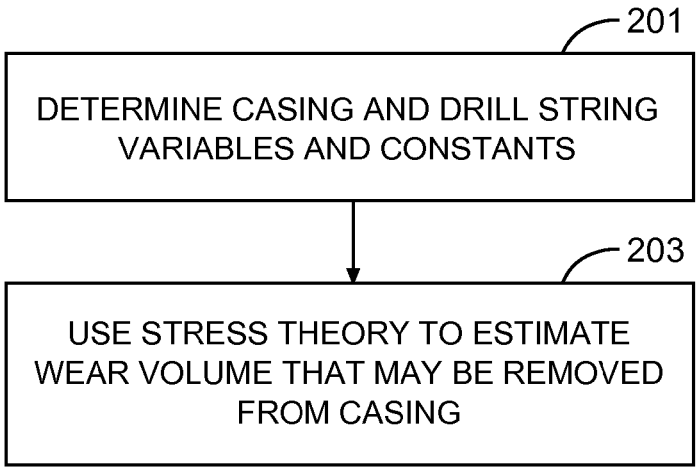
FIG. 2 illustrates a flowchart of an embodiment of a method for pre-planning of a drilling operation.

FIG. 2 illustrates a flowchart of an embodiment of a method for pre-planning of a drilling operation. The casing and drill string variables and constants used to determine the casing wear, as described previously, can be determined 201. For example, these variables and constants may include the normal load per unit width of the contacting element that is calculated based on the position of the string (e.g., inclination, azimuth) (e.g., $F_n$), the radii of curvature of the casing and the tool joint (e.g., $\rho_c$,$\rho_{tj}$), the modulii of elasticity of casing and the tool joint of the drill string (e.g., $E_c$, $E_{tj}$), and the Poisson's ratio of the casing and the tool joint of the drill string (e.g., $v_c$,$v_{tj}$).

Using the above information, the casing wear estimation model illustrated in Eq. 11 can thus be used to determine 203 when the casing thickness is adequate and safe for drilling. The casing wear estimation model illustrated in Eq. 11 is based on stress theory to estimate the wear volume that may be removed from the casing during the drilling operation.

Figure 3:
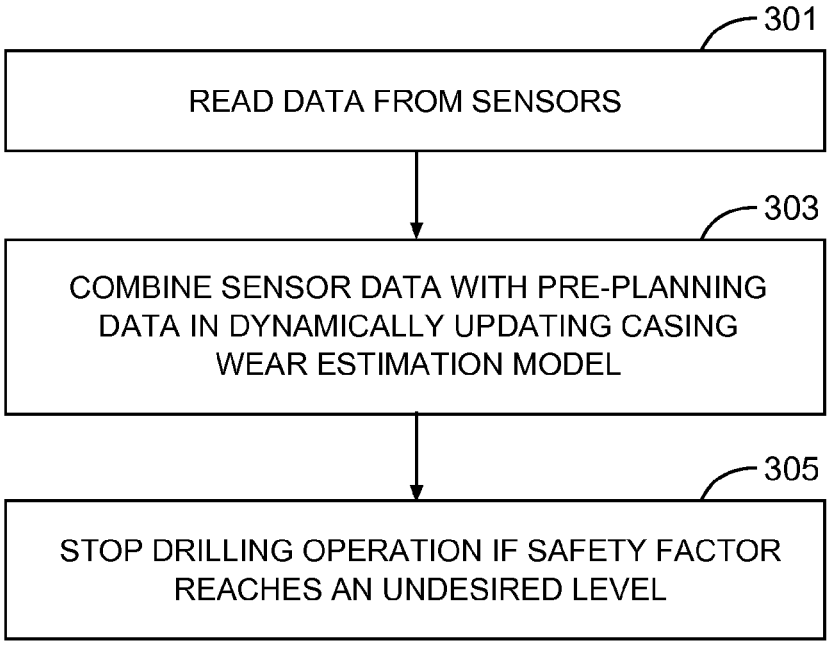
FIG. 3 illustrates a flowchart of an embodiment of a method for a real-time analysis of the drilling operation.

FIG. 3 illustrates a flowchart of an embodiment of a method for real-time analysis of the drilling operation to determine casing wear. Data from sensors in the drill string are read to monitor the drilling operation 301. The data can include the distance/depth of drilling, the rotational speed of the drill string, the ROP, and the length of the drill string. This data can be combined with variables and constants obtained during the pre-planning method, outlined previously, in order to dynamically update the casing wear estimation model illustrated in Eq. 11 303. This can provide a constant estimate of casing wear as the drilling operation is executed and, thereby, provide a safety factor during the drilling operation. If the safety factor reaches an undesired level (i.e., the safety factor indicates that the casing might be getting thinner than a thickness threshold for safe operation) the drilling operation can be stopped 305.

As an example of operation, a processor that is controlling the drilling operation can stop the drill when the safety factor reaches a predetermined level. In another operational embodiment, an indication provided by a controller can be used to inform a drill operator that the drilling operation should be stopped manually when the safety factor reaches the predetermined level.

Figure 4:
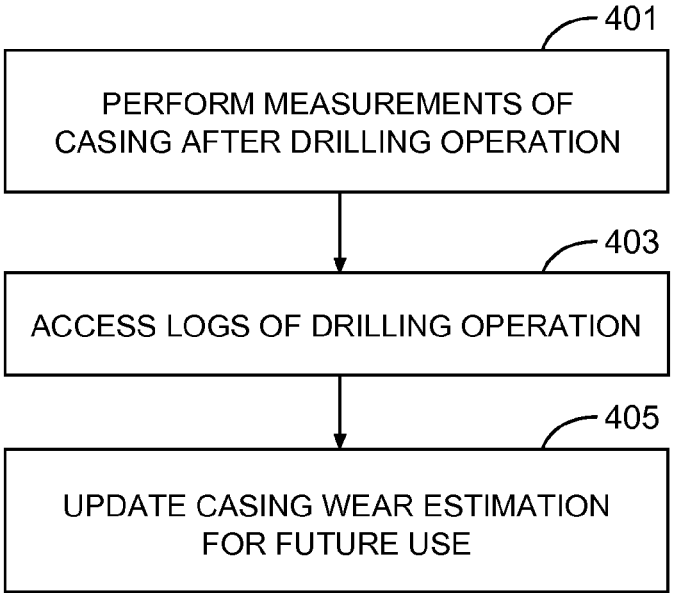
FIG. 4 illustrates a flowchart of an embodiment of a method for post-planning of the drilling operation.

FIG. 4 illustrates a flowchart of an embodiment of a method for post-planning of the drilling operation. After the drilling operation, the casing wear can be measured 401. Logs of data from the drilling operation can be accessed to gather statistical data regarding the drilling operation 403. This data can include the distance of drilling, the rotational speed of the drill string, as well as other data. The casing wear estimation model can be updated for future use 405 using the actual measured wear and the log data.

In various embodiments, a non-transitory machine-readable storage device can comprise instructions stored thereon, which, when performed by a machine, cause the machine to perform operations, the operations comprising one or more features similar to or identical to features of methods and techniques related to performing an estimation of casing wear. These operations include any one or all of the operations forming the methods shown in FIGS. 2-4. The physical structure of such instructions may be operated on by one or more processors.

A machine-readable storage device, herein, is a physical device that stores data represented by physical structure within the device. Examples of non-transitory machine-readable storage devices can include, but are not limited to, read only memory (ROM), random access memory (RAM), a magnetic disk storage device, an optical storage device, a flash memory, and other electronic, magnetic, and/or optical memory devices.

In various embodiments, a system can comprise a controller (e.g., processor) and a memory unit arranged such that the processor and the memory unit are configured to perform one or more operations in accordance with techniques to perform the estimation of casing wear that are similar to or identical to methods taught herein. The system can include a communications unit to receive data generated from one or more sensors disposed in a wellbore. The one or more sensors can include a fiber optic sensor, a pressure sensor, a drill string rotational sensor, or a strain gauge to provide monitoring of drilling and production associated with the wellbore. A processing unit may be structured to perform processing techniques similar to or identical to the techniques discussed herein. Such a processing unit may be arranged as an integrated unit or a distributed unit. The processing unit can be disposed at the surface of a wellbore to analyze data from operating one or more measurement tools downhole. The processing unit can be disposed downhole in as part of a sonde (e.g., in a wireline application) or a downhole tool, as part of a drill string (see FIGS. 6-7 below).

Figure 5:
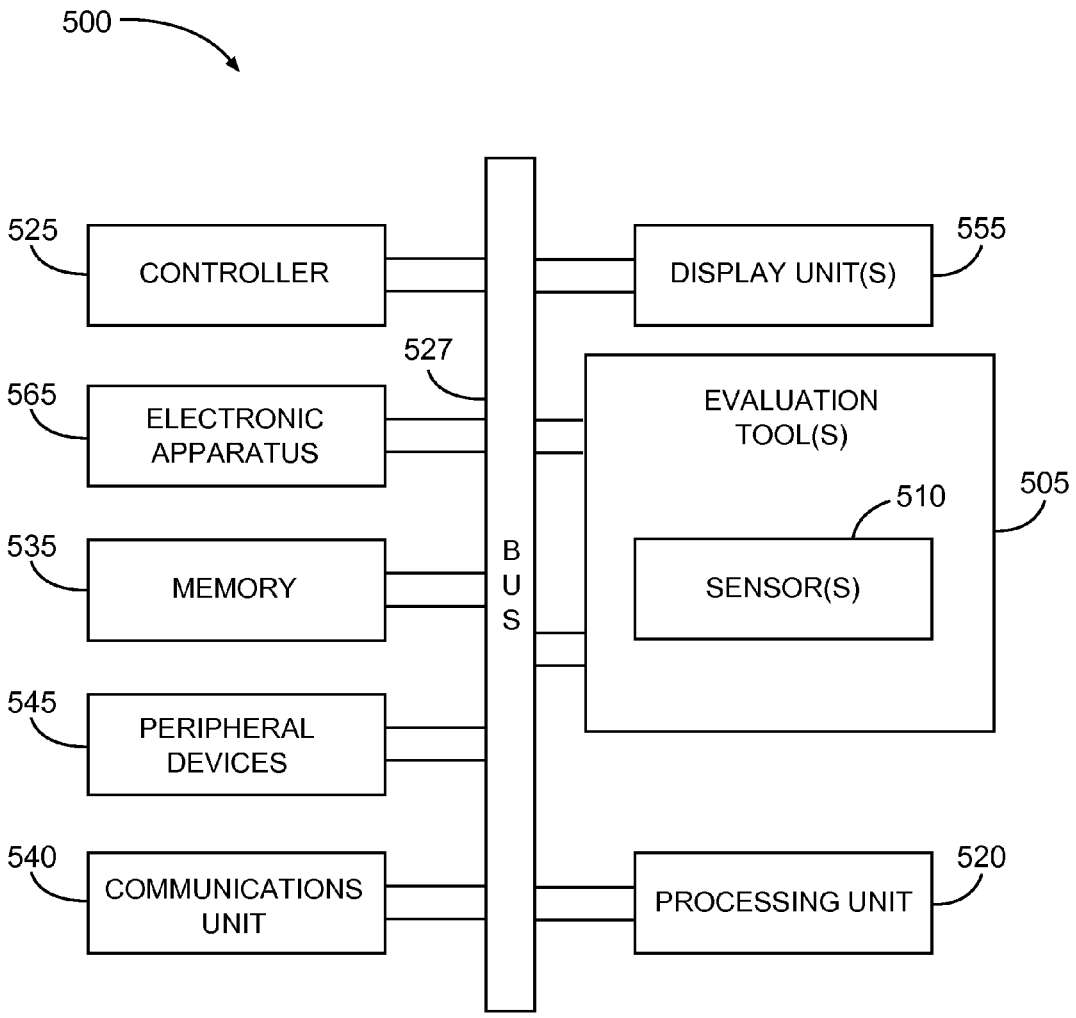
FIG. 5 shows a block diagram of an embodiment of a system operable to perform casing thickness reduction estimation.

FIG. 5 depicts a block diagram of features of an embodiment of an example system 500 operable to perform related to performing the estimation of casing wear. The system 500 can include a controller 525, a memory 535, an electronic apparatus 565, and a communications unit 540. The controller 525 and the memory 535 can be realized to manage processing schemes as described herein.

The memory 535 can be realized as one or more non-transitory machine-readable storage devices having instructions stored thereon. The instructions, when performed by a machine, can cause the machine to perform operations, the operations comprising the performance of estimating casing wear as taught herein. The controller 525 and the memory 535 can also be arranged to operate the one or more evaluation tools 505 to acquire measurement data as the one or more evaluation tools 505 are operated.

The processing unit 520 may be structured to perform the operations to manage processing schemes that include estimating casing wear in a manner similar to or identical to embodiments described herein. The system 500 may also include one or more evaluation tools 505 having one or more sensors 510 operable to make casing measurements with respect to a wellbore. The one or more sensors 510 can include, but are not limited to, a fiber optic sensor, a pressure sensor, or a strain gauge to provide monitoring drilling and production associated with the wellbore.

Electronic apparatus 565 can be used in conjunction with the controller 525 to perform tasks associated with taking measurements downhole with the one or more sensors 510 of the one or more evaluation tools 505. The communications unit 540 can include downhole communications in a drilling operation. Such downhole communications can include a telemetry system.

The system 500 can also include a bus 527. The bus 527 can provide electrical conductivity among the components of the system 500. The bus 527 can include an address bus, a data bus, and a control bus, each independently configured. The bus 527 can also use common conductive lines for providing one or more of address, data, or control, the use of which can be regulated by the controller 525.

The bus 527 may include network capabilities. The bus 527 can include optical transmission medium to provide optical signals among the various components of system 500. The bus 527 can be configured such that the components of the system 500 are distributed. Such distribution can be arranged between downhole components such as one or more sensors 510 of the one or more evaluation tools 505 and components that can be disposed on the surface of a well. Alternatively, various of these components can be co-located such as on one or more collars of a drill string, on a wireline structure, or other measurement arrangement (e.g., see FIGS. 6-7).

In various embodiments, peripheral devices 545 can include displays, additional storage memory, and/or other control devices that may operate in conjunction with the controller 525 and/or the memory 535. In an embodiment, the controller 525 can be realized as one or more processors. The peripheral devices 545 can be arranged to operate in conjunction with display unit(s) 555 with instructions stored in the memory 535 to implement a user interface to manage the operation of the one or more evaluation tools 505 and/or components distributed within the system 500. Such a user interface can be operated in conjunction with the communications unit 540 and the bus 527 and can provide for control and command of operations in response to analysis of the completion string or the drill string. Various components of the system 500 can be integrated to perform processing identical to or similar to the processing schemes discussed with respect to various embodiments herein.

Figure 6:
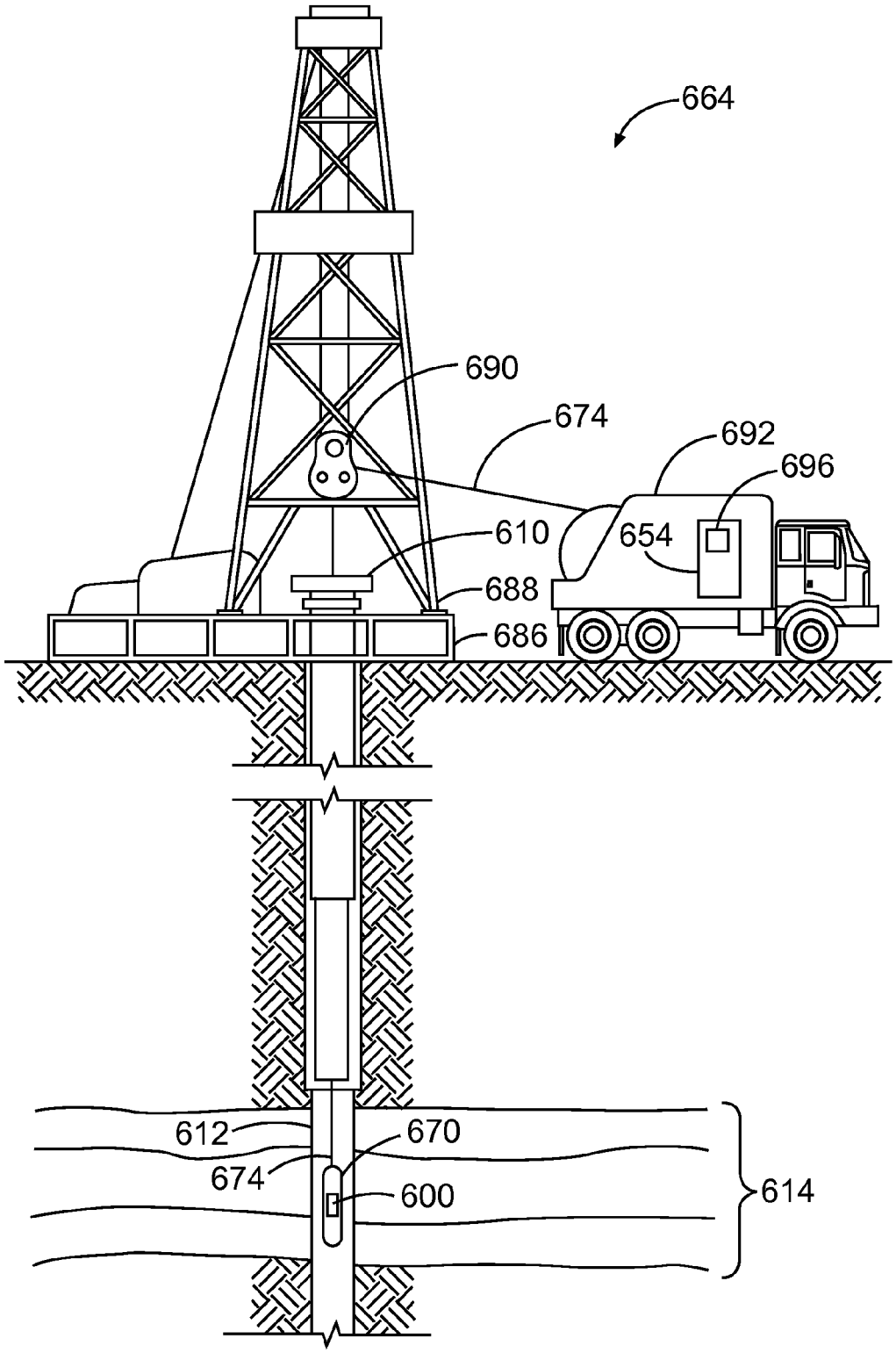
FIG. 6 wireline system implementation.
Figure 7:
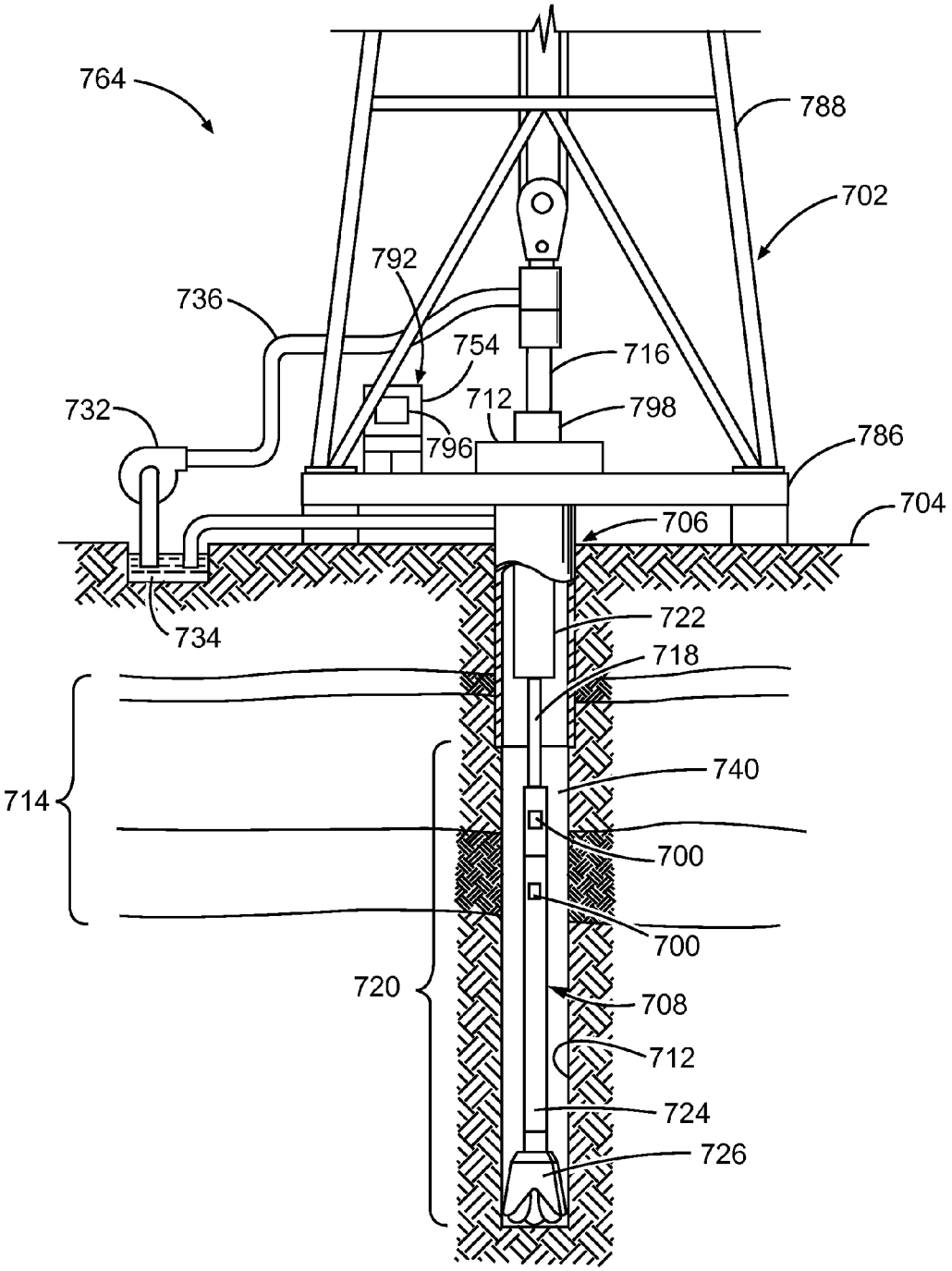
FIG. 7 drilling system implementation.

FIG. 6 illustrates a wireline system 664 embodiment. FIG. 7 illustrates a drilling rig system 764 embodiment. During a drilling operation of the well 712, as illustrated in FIG. 7, it may be desirable to estimate the casing wear.

The system 664 of FIG. 6 may comprise portions of a tool body 670 as part of a wireline logging operation that can include one or more sensors 600. The system of FIG. 7 may comprise a downhole measurement tool 724, as part of a downhole drilling operation, that can also include one or more sensors 700.

FIG. 6 shows a drilling platform 686 that is equipped with a derrick 688 that supports a hoist 690. Drilling of oil and gas wells is commonly carried out using a string of drill pipes connected together so as to form a drilling string that is lowered through a rotary table 610 into a wellbore or borehole 612. Here it is assumed that the drilling string has been temporarily removed from the borehole 612 to allow a wireline logging tool body 670, such as a probe or sonde, to be lowered by wireline or logging cable 674 into the borehole 612. Typically, the tool body 670 is lowered to the bottom of the region of interest and subsequently pulled upward at a substantially constant speed.

During the drilling of the nearby ranging well, measurement data can be communicated to a surface logging facility 692 for storage, processing, and/or analysis. The logging facility 692 may be provided with electronic equipment 654, 696, including processors for various types of signal processing, which may be used by the casing wear estimation model.

FIG. 7 shows a system 764 that may also include a drilling rig 702 located at the surface 704 of a well 706. The drilling rig 702 may provide support for a drill string 708. The drill string 708 may operate to penetrate a rotary table for drilling a borehole 712 through subsurface formations 714. The drill string 708 may include a Kelly 716, drill pipe 718, and a bottom hole assembly 720, perhaps located at the lower portion of the drill pipe 718.

The bottom hole assembly 720 may include drill collars 722, a downhole tool 724, and a drill bit 726. The drill bit 726 may operate to create a borehole 712 by penetrating the surface 704 and subsurface formations 714. The downhole tool 724 may comprise any of a number of different types of tools including MWD (measurement while drilling) tools, LWD tools, and others.

During drilling operations, the drill string 708 (perhaps including the Kelly 716, the drill pipe 718, and the bottom hole assembly 720) may be rotated by the rotary table. In addition to, or alternatively, the bottom hole assembly 720 may also be rotated by a motor (e.g., a mud motor) that is located downhole. The drill collars 722 may be used to add weight to the drill bit 726. The drill collars 722 may also operate to stiffen the bottom hole assembly 720, allowing the bottom hole assembly 720 to transfer the added weight to the drill bit 726, and in turn, to assist the drill bit 726 in penetrating the surface 704 and subsurface formations 714.

During drilling operations, a mud pump 732 may pump drilling fluid (sometimes known by those of skill in the art as "drilling mud") from a mud pit 734 through a hose 736 into the drill pipe 718 and down to the drill bit 726. The drilling fluid can flow out from the drill bit 726 and be returned to the surface 704 through an annular area 740 between the drill pipe 718 and the sides of the borehole 712. The drilling fluid may then be returned to the mud pit 734, where such fluid is filtered. In some embodiments, the drilling fluid can be used to cool the drill bit 726, as well as to provide lubrication for the drill bit 726 during drilling operations. Additionally, the drilling fluid may be used to remove subsurface formation 714 cuttings created by operating the drill bit 726.

In some embodiments, the system 764 may include a display 796 to present casing wear information and sensor responses as measured by the sensors 700. This information can be used in steering the drill bit 726 during the drilling operation. The system 764 may also include computation logic, such as processors, perhaps as part of a surface logging facility 792, or a computer workstation 754, to receive signals from transmitters and receivers, and other instrumentation.

It should be understood that the apparatus and systems of various embodiments can be used in applications other than those described above. The illustrations of systems 664, 764 are intended to provide a general understanding of the structure of various embodiments, and they are not intended to serve as a complete description of all the elements and features of apparatus and systems that might make use of the structures described herein.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A method comprising:

determining, by a computer system, values of casing and drill string variables and constants relating to contact stresses resulting from contact between a casing of a wellbore and a drill string disposed in the wellbore during a drilling operation, the variables and constants comprising one or more of a load per unit width of a contacting element, radii of curvature of the casing and a tool joint of the drill string, modulii of elasticity of the casing and the tool joint of the drill string, and Poisson's ratios of the casing and the tool joint of the drill string;

generating, by the computer system, an estimate of casing wear based on the determined values of the variables and constants, the casing wear represented by:

$$V = \pi 0.564 F_n D_{tj} N L t \left[ \frac{\frac{(\rho_c - \rho_{tj})}{\rho_c \rho_{tj}}}{\left(\frac{1 - v_c^2}{E_c}\right) + \left(\frac{1 - v_{tj}^2}{E_{tj}}\right)} \right]^{1/2} \text{ inches}^3/\text{feet},$$

where V=a volume that is removed per linear distance from the casing as a result of contact between the casing and the drill string, $F_n$=the load per unit width of a contacting element, N=a rotary speed of the drill string, $D_{tj}$=a tool-joint diameter, t=a contact time between the casing and the drill string as a function of a depth of drilling and a rate of penetration of the drill string, $\rho_c$, $\rho_{tj}$=the radii of curvature of the casing and the tool joint, respectively, $E_c$, $E_{tj}$=the modulii of elasticity of the casing and the tool joint, respectively, and $v_c$,$v_{tj}$=values of the Poisson's ratio of the casing and the tool joint, respectively;

receiving, by the computer system from sensors coupled to the drill string, data measured by the sensors during the drilling operation, the sensor data comprising one or more of the depth of drilling, the rotary speed of the drill string, and the rate of penetration of the drill string;

dynamically updating, by the computer system, the estimate of casing wear, based on the sensor data received during the drilling operation;

monitoring, by the computer system, a thickness of the casing during the drilling operation, based on the dynamically updated estimate of casing wear;

determining, by the computer system, whether or not the thickness of the casing reaches a threshold, based on the monitoring; and responsive to determining that the thickness of the casing has reached the threshold, stopping the drilling operation.

2. The method of claim 1, further comprising calculating the load per unit width of the contacting element based on an inclination and azimuth of the drill string.

3. The method of claim 1, further comprising activating an alarm to indicate the threshold has been reached.

4. The method of claim 1, further comprising determining the contact time, t, by $$t = \frac{L \times L_{tj}}{ROP \times L_{dp}}$$

minutes, where L=drilling distance (feet), $L_{tj}$=drilling distance of the tool joint (feet), $L_{dp}$=drilling distance of the drill string (feet); and ROP=rate of penetration into a geological formation (feet/minute).

5. The method of claim 1, wherein the sensors coupled to the drill string include a fiber optic sensor, a pressure sensor, and a strain gauge to monitor drilling or production conditions associated with the wellbore.

6. The method of claim 1, wherein dynamically updating the estimate of the casing wear is substantially in real time using the sensor data.

7. A non-transitory machine-readable storage device having instructions stored thereon, which, when performed by a machine, cause the machine to perform operations, the operations comprising the method of claim 1.

8. A method comprising:

determining, by a computer system, casing and drill string variables and constants relating to contact stresses resulting from contact between a casing of a wellbore and a drill string disposed in the wellbore during a drilling operation, the variables and constants comprising a load per unit width of a contacting element, radii of curvature of the casing and a tool joint of the drill string, modulii of elasticity of the casing and the tool joint of the drill string, and Poisson's ratios of the casing and the tool joint of the drill string;

generating, by the computer system, a first estimate of casing wear, based on the variables and constants;

receiving, by the computer system via a communications unit, data from sensors coupled to the drill string disposed in the wellbore, the sensor data comprising one or more of a depth of drilling, a rotational speed of the drill string, and a rate of penetration of the drill string;

dynamically generating, by the computer system, a second estimate of casing wear based on the received sensor data and at least one of the variables and constants;

monitoring, by the computer system, a thickness of the casing during the drilling operation, based on the dynamically generated second estimate of casing wear;

determining, by the computer system, whether or not the thickness of the casing has reached or exceeded a predetermined value, based on the monitoring; and halting, by the computer system, the drilling operation when it is determined that the thickness of the casing has reached or exceeded the predetermined value, wherein each of the first and second estimates of casing wear are generated by:

$$V = \pi 0.564 F_n D_{tj} N L t \left[ \frac{\frac{(\rho_c - \rho_{tj})}{\rho_c \rho_{tj}}}{\left(\frac{1 - v_c^2}{E_c}\right) + \left(\frac{1 - v_{tj}^2}{E_{tj}}\right)} \right]^{1/2} \text{inches}^3/\text{feet},$$

where V=a volume that is removed per linear distance from the casing as a result of contact between the casing and the drill string, $F_n$=the load per unit width of a contacting element, N=the rotational speed of the drill string, $D_{tj}$=a tool-joint diameter, t=a contact time between the casing and the drill string as a function of the depth of drilling and the rate of penetration of the drill string, $\rho_c$, $\rho_{tj}$=the radii of curvature of the casing and the tool joint, respectively, $E_c$, $E_{tj}$=the modulii of elasticity of the casing and the tool joint, respectively, and $v_c$,$v_{tj}$=values of the Poisson's ratio of the casing and the tool joint, respectively.

9. The method of claim 8, wherein the sensors coupled to the drill string include a fiber optic sensor, a pressure sensor, and a strain gauge to monitor drilling or production conditions associated with the wellbore.

10. The method of claim 8, wherein the drilling operation includes a plurality of drilling operations, the first estimate of casing wear is generated during a first drilling operation, the second estimate of casing wear is generated during a second drilling operation, and the method further comprises:

measuring actual casing wear after conducting the first drilling operation; and updating the first estimate of casing wear, prior to conducting the second drilling operation, based on the measured actual casing wear.

11. The method of claim 10, further comprising updating the first estimate of casing wear based on reading drilling data from logs of the first drilling operation.

12. The method of claim 8, wherein generating the second estimate is based on a Hertzian approach.

13. A system comprising:

a sensor coupled to a drill string disposed in a wellbore;

a communications unit that receives data generated from the sensor, the sensor data comprising one or more of a depth of drilling, a rotational speed of the drill string, and a rate of penetration of the drill string; and a controller coupled to the sensor via the communications unit:

dynamically generate an estimate of casing wear for the wellbore during a drilling, based on data received from the sensor and one or more variables and constants relating to contact stresses resulting from contact between the drill string and a casing of the wellbore during the drilling operation, the one or more variables and constants including a load per unit width of a contacting element, radii of curvature of the casing and a tool joint of the drill string, modulii of elasticity of the casing and the tool joint of the drill string, and Poisson's ratios of the casing and the tool joint of the drill string;

monitor a thickness of the casing during the drilling operation, based on the dynamically generated estimate of the casing wear;

determine whether or not the thickness of the casing reaches a predetermined value, based on the monitoring; and stop the drilling operation when it is determined that the thickness of the casing has reached the predetermined value, wherein the controller generates the estimate of the casing wear by:

$$V = \pi 0.564 F_n D_{tj} N L t \left[ \frac{\frac{(\rho_c - \rho_{tj})}{\rho_c \rho_{tj}}}{\left(\frac{1 - v_c^2}{E_c}\right) + \left(\frac{1 - v_{tj}^2}{E_{tj}}\right)} \right]^{1/2} \text{inches}^3/\text{feet},$$

where V=a volume that is removed per linear distance from the casing as a result of contact between the drill string and the casing, $F_n$=the load per unit width of a contacting element, N=the rotational speed of the drill string, $D_{tj}$=a tool-joint diameter, t=a contact time between the drill string and the casing as a function of the depth of drilling and the rate of penetration of the drill string, $\rho_c$, $\rho_{tj}$=the radii of curvature of the casing and the tool joint, respectively, $E_c$, $E_{tj}$=the modulii of elasticity of the casing and the tool joint, respectively, and $v_c$,$v_{tj}$=values of the Poisson's ratio of the casing and the tool joint, respectively.

14. The system of claim 13, wherein the sensor is a fiber optic sensor disposed along the drill string.

15. The system of claim 13, wherein the sensor includes one or more sensors comprising a fiber optic sensor, a pressure sensor, and/or a strain gauge to monitor drilling or production conditions associated with the wellbore.

16. The system of claim 13, wherein the controller is further configured to dynamically update the estimate of the casing wear in real time using the sensor data.

17. The system of claim 13, wherein the predetermined value is indicated when the casing is thinner than a thickness threshold determined by a safety factor.

18. The system of claim 13, wherein the controller is further configured to access logs of statistical data associated with the drilling operation to gather statistical data regarding the drilling operation.

19. The system of claim 18, wherein the statistical data comprises a distance of drilling and/or a rotational speed of the drill string.

* * * * *